United States Patent [19]

Anderson

[11] 4,208,932

[45] Jun. 24, 1980

[54] FEEDING AND CUTTING MECHANISM

[75] Inventor: Andrew W. Anderson, West Caldwell, N.J.

[73] Assignee: Scandia Packaging Machinery Company, Clifton, N.J.

[21] Appl. No.: 776,550

[22] Filed: Mar. 11, 1977

[51] Int. Cl.[2] ..... B26D 3/00; B26D 11/00

[52] U.S. Cl. ..... 83/303; 83/311; 83/344; 83/346; 83/348; 93/1 TS

[58] Field of Search ..... 83/303, 344, 346, 347, 83/348, 562, 311, 505, 506, 482; 93/1 TS

[56] References Cited

U.S. PATENT DOCUMENTS

| | | | |
|---|---|---|---|
| 1,542,097 | 6/1925 | Ripley | 83/348 X |
| 1,856,659 | 5/1932 | Sandfanander | 83/346 X |
| 1,863,619 | 6/1932 | Cameron | 83/505 X |
| 2,292,723 | 8/1942 | Stocker | 83/506 |
| 2,837,978 | 6/1958 | Anderson | 83/332 X |
| 3,303,758 | 2/1967 | Holt | 93/1 TS |
| 3,379,598 | 4/1968 | Petru | 93/1 TS |
| 3,386,323 | 6/1968 | Dovey | 83/482 X |
| 3,644,109 | 2/1972 | Klink et al. | 83/348 X |
| 3,744,361 | 7/1973 | Van Doorn et al. | 83/348 X |
| 3,855,890 | 12/1974 | Lynch et al. | 83/344 X |

*Primary Examiner*—J. M. Meister
*Attorney, Agent, or Firm*—Neil F. Markva

[57] ABSTRACT

A cutting mechanism including a backing roller having a longitudinal axis of rotation and a rotatably mounted cutting member having a cutting edge and a longitudinal axis of rotation disposed parallel to the axis of rotation of the roller member. The backing roller is freely rotatably mounted about its axis of rotation. Thus, the cutting member cuts at different locations along the circumferential surface of the backing roller each time. The backing roller is resiliently mounted to float in a direction transverse to a plane extending vertically through its axis of rotation. The roller is mounted on a carrier body that is laterally movable to effect movement of the roller in a direction parallel to the axis of rotation of the roller. Unique timing belt and gear drive mechanisms are used to effect driving of the draw rollers and cutting devices. A particular guide mechanism is used to direct the tear strip from a supply to the point where it is superimposed on a web of wrapping material.

15 Claims, 9 Drawing Figures

37
IV
IV
13
36
34
12
28
30
10
31
35
27
19
21
22
11
18
19
20

12
13
37
12
60
28
65
64
64
65
29
27
25
26

Fig. 6
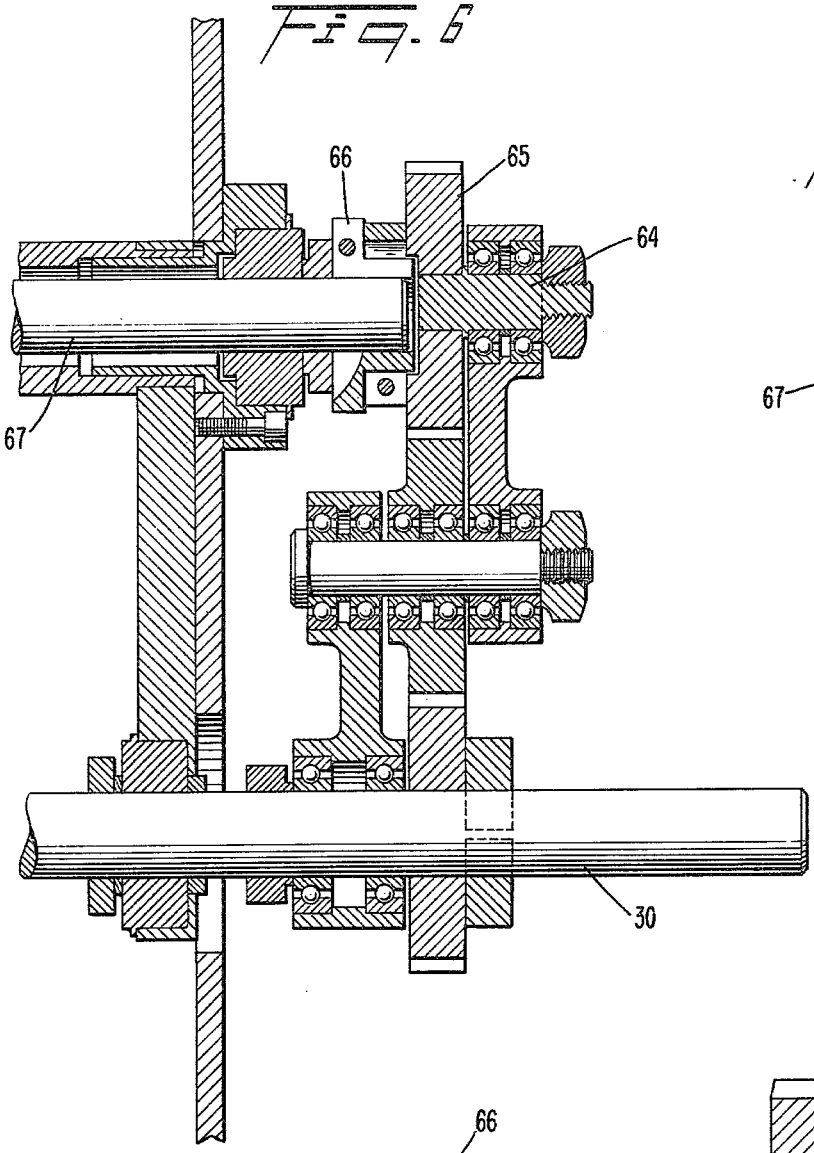
Fig. 8
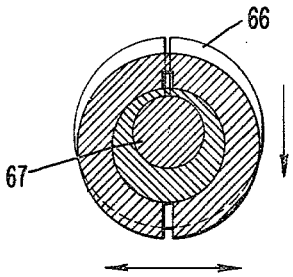
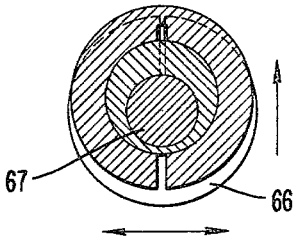
Fig. 9
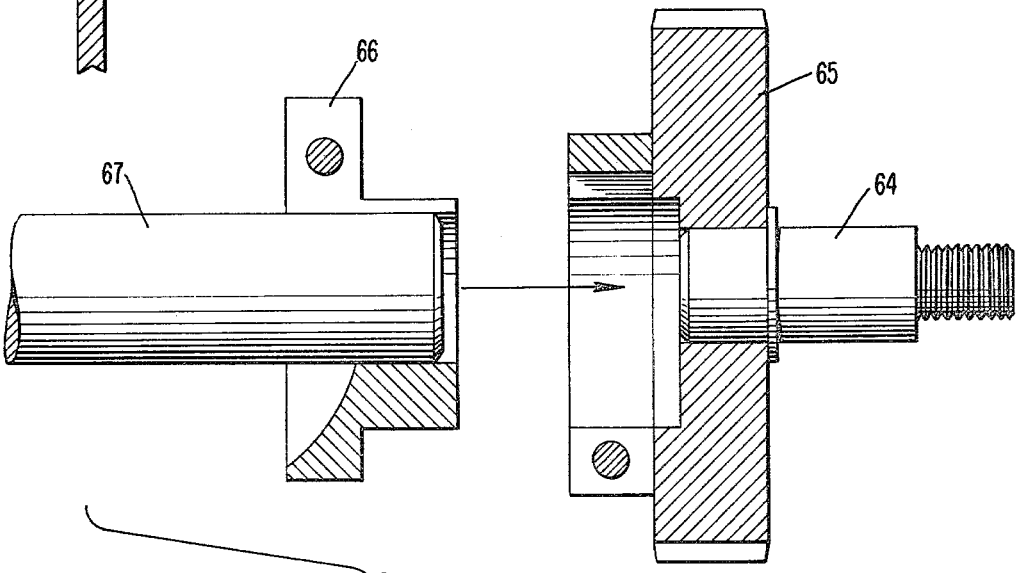
Fig. 7

FEEDING AND CUTTING MECHANISM

BACKGROUND OF THE INVENTION

This invention relates to feeding and cutting mechanisms for wrapping machines. More particularly, the invention is directed to the mechanism for cutting a sheet from a continuous supply web and superimposing a tear strip thereon. The combination is then wrapped around an article or package.

The sheet feeding and cutting mechanism disclosed in U.S. Pat. No. 2,837,978 was used with film material such as cellophane. The film thickness of the webbed material was about 0.001 inch. The disclosure of the earlier patent represents the present state of the art. U.S. Pat. No. 2,837,978 is hereby incorporated by reference with its teaching becoming a part of this disclosure.

For various reasons peculiar to the packaging industry, many new types of thin film have been developed. These include, polyethylene, polypropylene, polyesters and others which come in very thin thicknesses and with different cutting characteristics than the cellophane films previously used. The film thickness is now down to about 0.0008 inch or about a 20% decrease. Greater knife penetration is required to cut the new film. Generally, a 40% penetration is required for cellulose and up to 80% penetration is required for some polyfilms having a thickness of about 0.0005 inch. These physical relationships have become more critical due to the high speed operation necessary to meet current production demands.

The prior art mechanism is completely gear driven and provides a rigid or fixed relationship between the moving parts of the cutting head mechanism. A knife is rotatably mounted adjacent a rotatable platen or backing roller. The web and tear strip combination passes between the knife and the roller wherein the web is cut and sheets are separated therefrom. With respect to the tear strip, cuts are made parallel to and across the tear strip. The tear strip cuts are either made by an H-knife, a U-knife or separate knife edges disposed parallel to and transverse to the tear strip. In this latter instance, it is necessary to have two separate backing roller positions adjacent two separate cutting members.

The prior art mechanisms used for cutting the web of material having a tear strip superimposed thereon are generally fixed with respect to the size package and the location of the tear strip on the package. That is, there is no versatility in the prior art machines. The tear strip is maintained in a substantially fixed location with respect to the web of material being cut. Furthermore, the backing rollers for the cutting members are also driven through either gears or timing belts from the main drive shaft of the wrapping machine.

In the prior art machine of the U.S. Pat. No. 2,837,978, it is also necessary to change to the separate gear members if it is desired to change the length of sheet being cut from the continuous web of wrapping material. This necessarily increases the amount of down time during production and also requires additional machining and replacement part expense.

In some prior art models, interchangeable backing rollers have been used every time a different length of material was to be cut in the cutting mechanism. Again, this requires additional cost for a plurality of separate parts and requires the additional drive means for the backing roller. Each time the backing roller radius is changed to accommodate a different length of sheet, it is necessary to change the drive gears for the backing roller.

PURPOSE OF THE INVENTION

The primary object of the invention is to provide an improved web and tear strip feeding and cutting mechanism that can handle existing thin film materials.

Another object of this invention is to provide a cutting mechanism is which the length of the sheet being cut from a continuous web can be varied through the changing of a single interchangeable gear member.

A further object of this invention is to provide a drive arrangement whereby a sheet cutting device is operated in a one-to-one relationship with a tear strip cutting mechanism through the use of a single interchangeable gear and a timing belt arrangement.

Another object of this invention is to provide a cutting mechanism having the versatile capability of changing location of the superimposition of the tear strip on the wrapper sheet being cut from the web of a wrapping material.

A still further object of this invention is to provide a laterally displaceable cutting member adjacent the laterally displaceable backing roller member that is freely rotatable and spring loaded to effect the desired cutting of the tear strip regardless of its location on the web of wrapping material.

A still further object of this invention is to provide a novel guide arrangement for supplying the tear strip from a supply of tear strip material to the location of the backing roller against which the tear strip is cut.

SUMMARY OF THE INVENTION

These objects and other advantages will be accomplished through the use of a cutting mechanism as described herein. The cutting mechanism includes a backing roller means having a longitudinal axis of rotation and a rotatably mounted cutting means having a longitudinal axis of rotation disposed parallel to the axis of rotation of the roller means. The backing roller means is freely rotatably mounted about its axis of rotation. That is, it is not driven. The backing roller means is resiliently mounted to float in a direction transverse to a plane extending vertically through the axis of rotation thereof. The backing roller mounting means is laterally movable to effect movement of the roller means in a direction parallel to its axis of rotation. This enables that adapting of the cutting mechanism to any particular size article or package being wrapped in a wrapping machine.

Another feature of the invention is directed to the driving arrangement used to operate the cutting means against the freely rotating backing roller means and the draw roller means used to feed the tear strip and web of material into the cutting mechanism. The web cutting means and the tear strip cutting means are all driven in a one-to-one relationship. A main drive gear means includes a single interchangeable gear member which may be changed to produce a different sized sheet being cut from the web of material. Timing belts are used to drive a drive roller directly from the main drive mechanism. The cutting members for the tear strip are also driven by a timing belt driven from the main drive mechanism. Further draw roller means are used to provide the tear strip from the tear strip supply through the use of a further timing belt interconnected with a draw roller used to draw the web of continuous wrapping sheet from its supply.

BRIEF DESCRIPTION OF DRAWINGS

Other objects of this invention will appear in the following description and appended claims, reference being made to the accompanying drawings froming a part of the specification wherein like reference characters designate corresponding parts in the several views.

FIG. 6 is a fragmentary sectional view of an eccentric drive device used in the cutting mechanism of this invention;

FIG. 7 is an exploded view of the eccentric end of the device as shown in FIG. 6; and FIGS. 8 and 9 show the extreme positions of the eccentric end of the device shown in FIG. 6.

DESCRIPTION OF SPECIFIC EMBODIMENTS

Figure 1:
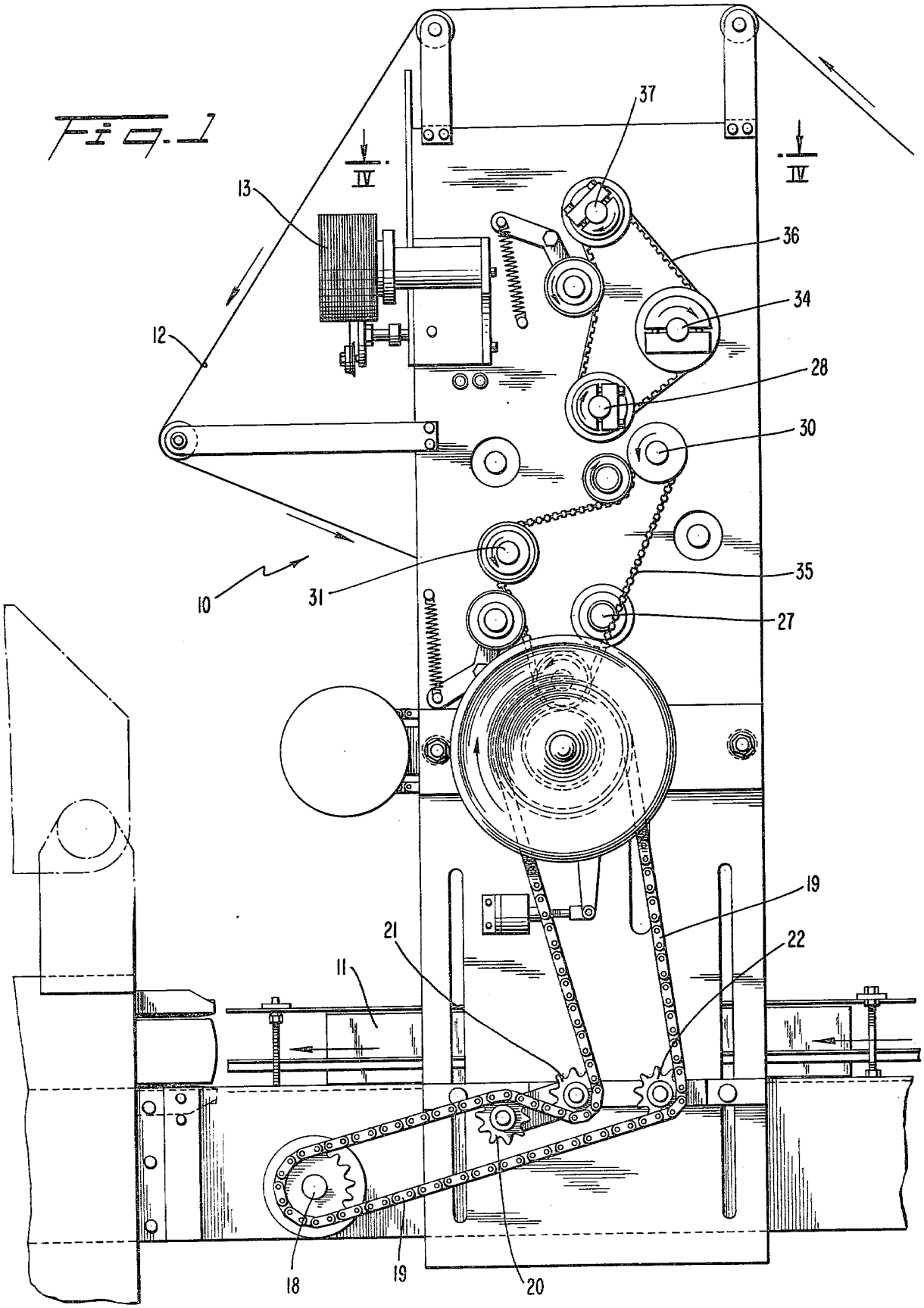
FIG. 1 is a side-elevational view of the cutting mechanism made in accordance with this invention.
Figure 2:
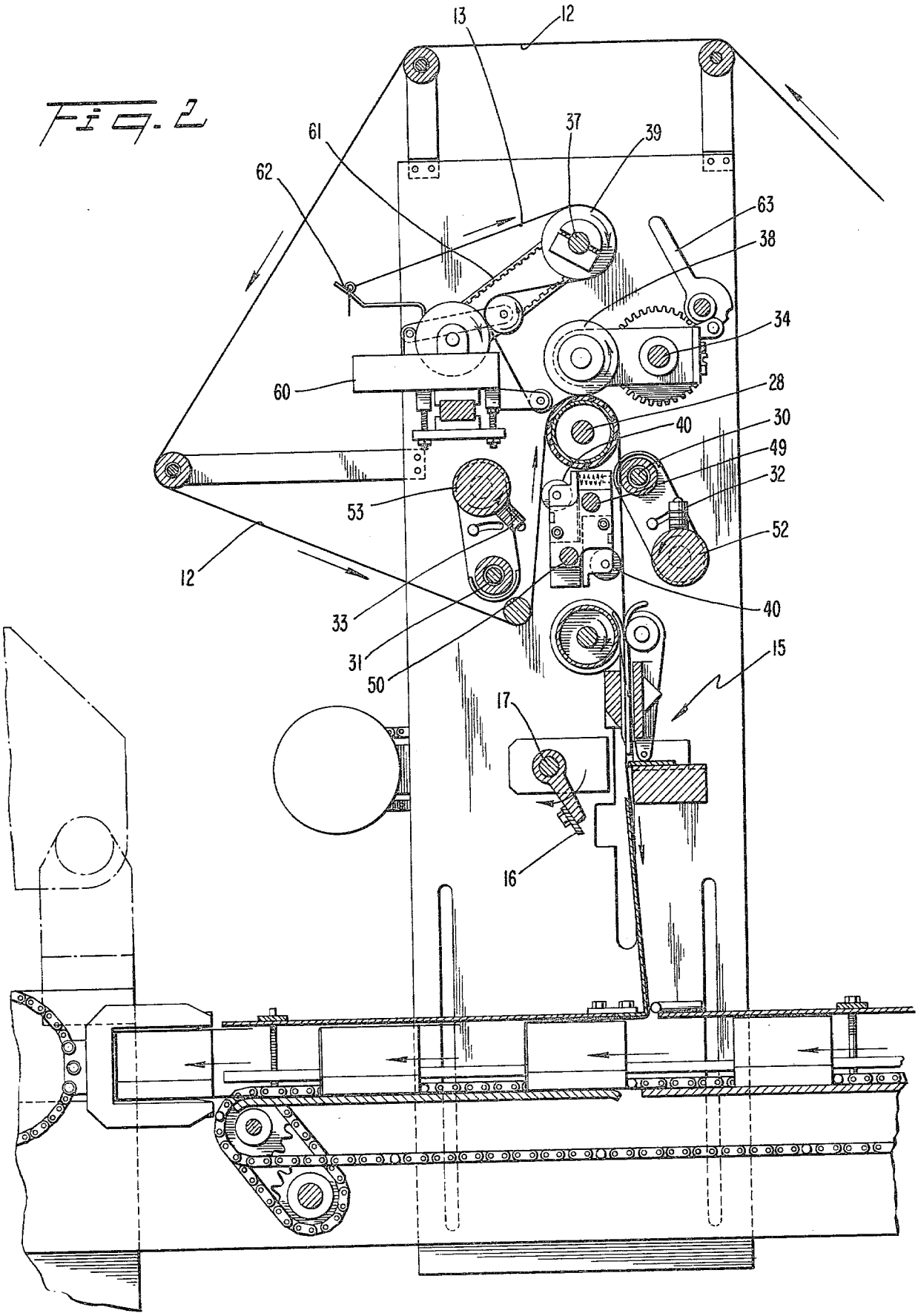
FIG. 2 is a cross-sectional view through the cutting mechanism as shown in FIG. 1.
Figure 3:
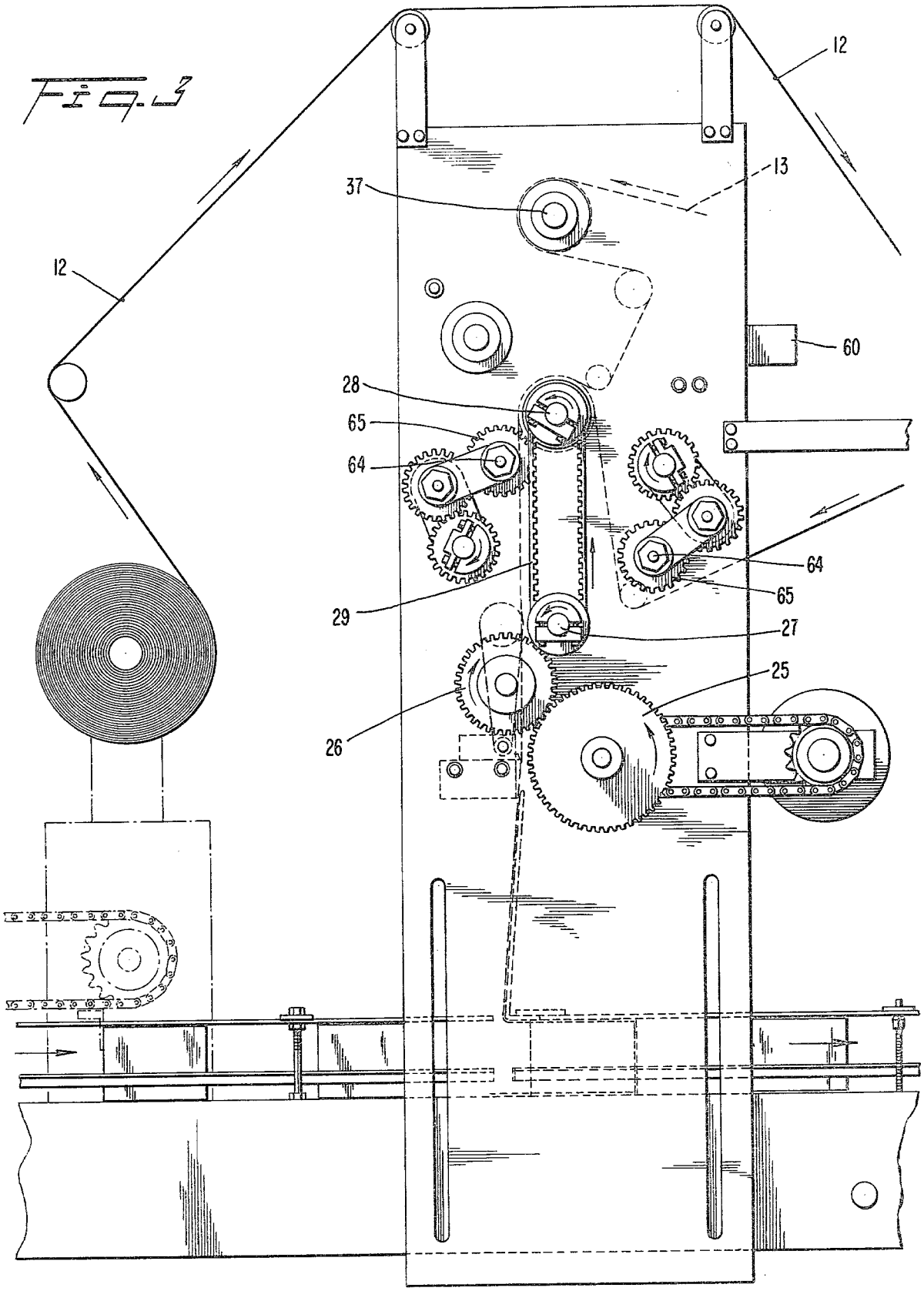
FIG. 3 is a side-elevational view from the side opposite the cutting mechanism as shown in FIG. 1.

More specifically, referring to the drawings, the cutting mechanism generally designated 10 is shown in combination with a wrapping machine for wrapping packages 11. The cutting mechanism 10 is used to cut sheets from the web of film 12 on which a tear strip 13 is superimposed. Sheets are cut from the web 12 by the sheet cutting arrangement generally designated 15. Such a mechanism is well known in the prior art. The cutting blade 16 is rotated on shaft 17 which is driven from the main drive 18 via chain 19. The idler sprockets 20, 21 and 22 are used to adjust the tension on chain 19 when it is necessary to vertically adjust the cutting mechanism 10.

The interchangeable gear 25 meshes with the gear 26 which engages a gear (not shown) fixedly secured to shaft 27 and thereby rotates and drives the draw roller shafts 27 and 28 via the timing belt 29. Thus, the timing belt 29 follows the gear speed of gear 25. The larger the gear 25, the larger the sheet that is cut from the web 12. If it is desired to have a different size sheet cut, it is necessary to simply change the single interchangeable gear 25 to obtain the desired results.

This is possible because the drive shafts 30 and 31 for the cutting members 32 and 33, respectively, are also directly driven in a one-to-one relationship with the cutting shaft 17 via the timing belt 35. The gear (not numbered) on shaft 17 directly drives a pulley for moving timing belt 35.

As noted above, the draw roller shaft 28 is driven from the main drive side of the cutting mechanism via timing belt 29. The timing belt 36 is meshed with the other end of the draw roller shaft 28 to drive the pressure roller drive gear shaft 34 and tear tape roller shaft 37 in a synchronized peripheral speed relationship. The use of the opposing ends of the common draw roller shaft 28 to effect driving of the pressure roller 38 and draw roller 39 together with the timing belt drive 36 automatically synchronizes and coordinates all movement through the simple change of the interchangeable gear 25.

Backing rollers 40 and 41 are disposed adjacent and work in cooperation with cutting members 32 and 33, respectively. Rollers 40 and 41 are identically mounted on a carrier body 45. Detail of the specific mounting is noted with respect to roller 41 which is freely rotatably disposed on carrier element 42. Element 42 is pivotally mounted around pivot point 43 and urged toward the cutting member 33 by the biasing force of spring 44.

Carrier body 45 is slidably fixed on shafts 49 and 50. That is, the carrier body may be laterally moved along shafts 49 and 50 across the width of the cutting mechanism 10. Additionally, the cutting elements 32 and 33 are mounted upon base members 52 and 53, respectively. The base members 52 and 53 are mounted on shafts which may be laterally adjusted with respect to the width of the cutting mechanism 10. The cutting elements 32 and 33 fit into holes drilled into the base members 52 and 53 in a manner known in the prior art and intermittently cut the thin film against the rollers 40 and 41 on each rotation thereof as is evident in the drawing. The gear on shaft 17 is never changed. The peripheral speed of the cutting edges is changed by adjusting the radial location of the cutting edge upon movement of cutting members 32 and 33 in and out of base members 52 and 53, respectively. The basic distinction is that there are a plurality of openings disposed along the length of the base members 52 and 53. Thus, there is a possibility of changing the lateral disposition of elements 32 and 33 by placing them in a different opening and/or adjustably moving the appropriate carrying shaft along its longitudinal axis.

Figure 4:
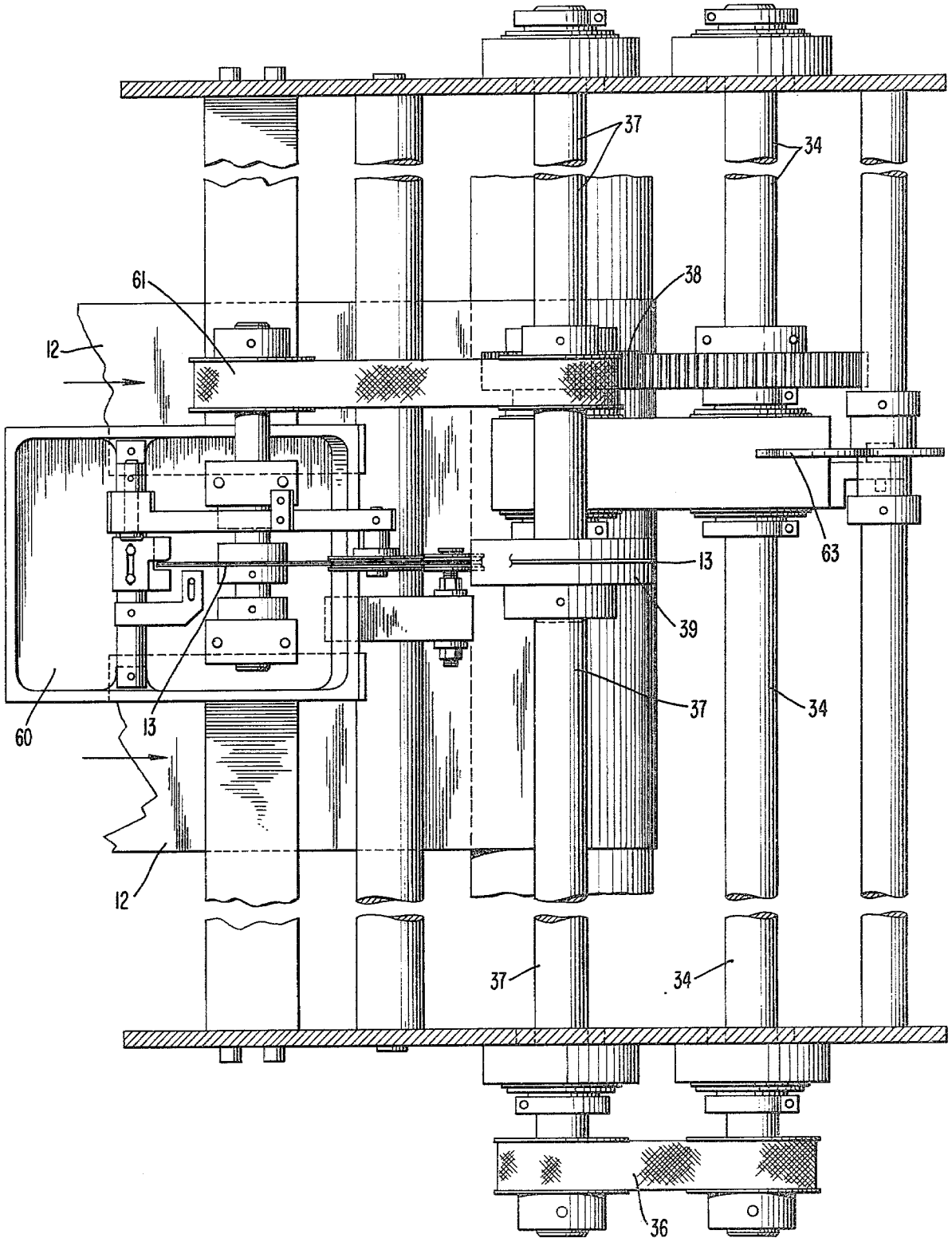
FIG. 4 is a fragmentary sectional view taken along line IV—IV of FIG. 1.
Figure 5:
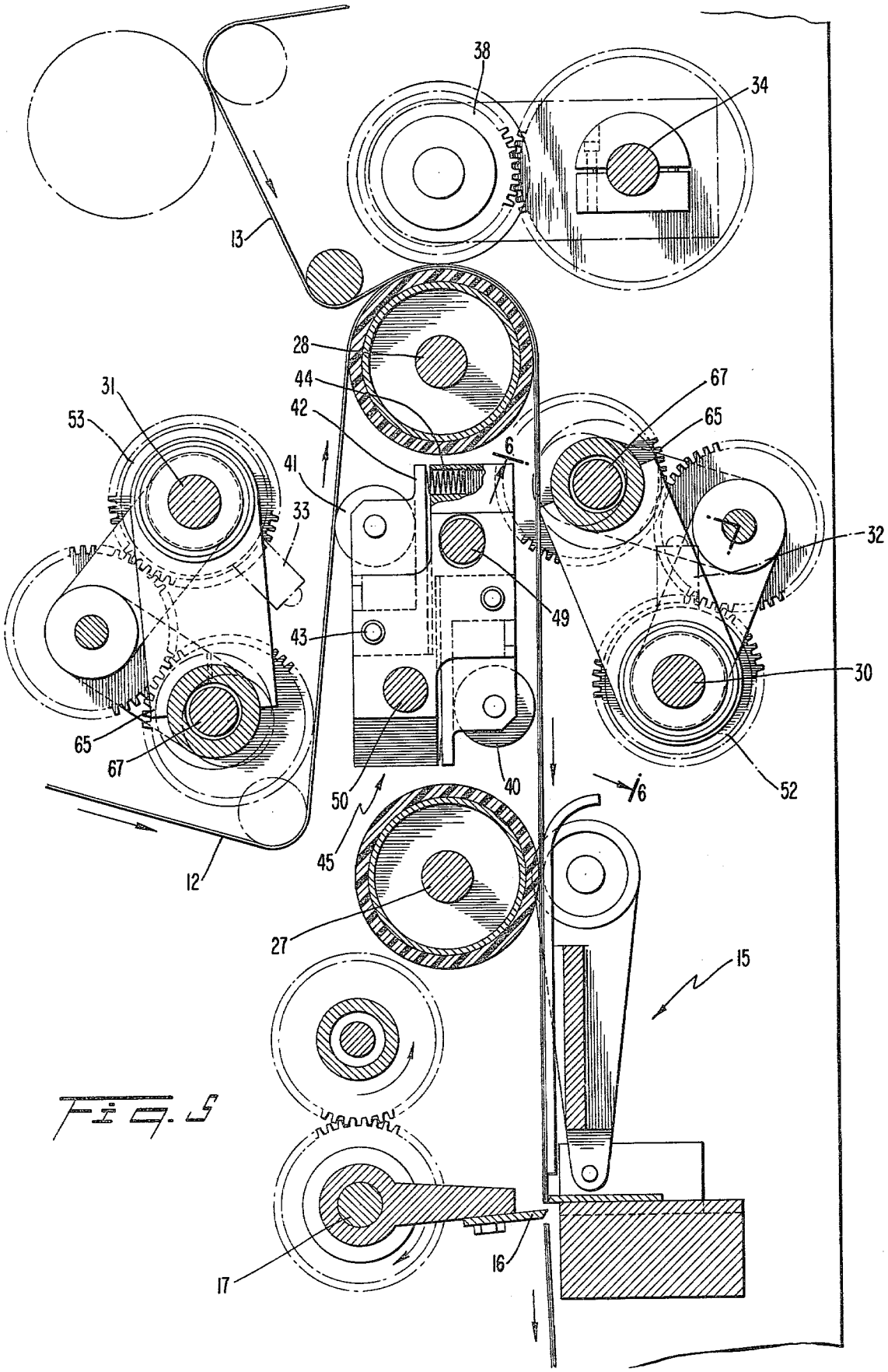
FIG. 5 is an enlarged cross-sectional view of a detail of a cutting mechanism made in accordance with this invention.

As shown in FIG. 4, the glue pot 60 is also slidably fixedly movable across the width of the cutting mechanism 10. The timing belt 61 is used to drive the glue pot 60 in synchronization with the drive of draw roller shaft 28 via the tape draw roller shaft 37.

A guide member 62 is mounted with the glue pot 60 for guiding the tear tape 13 from its supply roll to the specific location where the tear tape 13 is to be superimposed on the web 12. The spool on which tear tape 13 is stored is rotatable about an axis that is parallel to the direction of movement for the packages 11 through the cutting mechanism 10.

Upon rotation of the draw roller shafts 27 and 28 the web 12 and tape 13 are drawn vertically downwardly through the cutting mechanism 10. The force of pressure roller 38 toward draw roller shaft 28 is adjustable via the handle 63. The eccentrically mounted shafts 30 and 31 will either speed up or slow down the peripheral speed of elements 32 and 33, respectively. Referring to FIGS. 6 through 9, stub 64 is concentrically mounted on gear 65. The collar 66 is eccentrically mounted with respect to shaft 67. Rotation of the gear 65 about shaft 67 will cause the stub 64 to move upwardly and downwardly and back and forth as shown by the arrows in FIGS. 8 and 9. When the length of the sheet being cut from web 12 is changed, the eccentric arrangement allows the peripheral speed of the cutting element 32 to change a little bit more. The total eccentricity can exist up to $\frac{5}{8}$ inch as the eccentrics turn. Thus, it is possible to either speed up or slow down the knife that is carried on the rotating shaft. Whether the peripheral speed is slowed down or speeded up depends upon its eccentric disposition on the shaft. The simple readjustment of the diameter of the cutting element will result in achieving the desired cut against the spring-loaded, freely rotatable backing roller 40.

In this specific embodiment, the backing rollers 40 and 41 are roller bearings which are not driven. It is simply a matter of adjusting their lateral disposition across the width of the cutting mechanism 10 to achieve the desired results.

As shown in FIG. 7, there is a concentric drive relationship wherein the longitudinal axes of shaft 67 and stub 64 are in alignment. That is, the axes are coextensive. This position is generally used for the cutting range. However, if it is desired to increase the length of the sheet being cut from the web 12, the eccentric assembly will be set to use the cutting edge in conjunction with the high speed side of the eccentric. If it is desired to decrease the length of the sheet being cut from the web 12, the eccentric assembly will be set to use the cutting edge in conjunction with the low speed side of the eccentric. Circumferential adjustment of collar 66 around shaft 67 will correspondingly effect the desired setting of the high and low speed side of the eccentric.

While the feeding and cutting mechanism has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A cutting mechanism for effecting cutting thin film materials such as polyethylene, polypropylene and polyesters, said mechanism comprising:

(a) backing roller means having a longitudinal axis of rotation and including bearing wheels, (b) a cutting element detachably mounted on a rotatable base means and having a cutting edge which intermittently cuts the thin film and a longitudinal axis of rotation disposed parallel to the axis of rotation of the roller means, (c) said bearing wheels being freely rotatably mounted about their axis of rotation, (d) means mounting the bearing wheels to resiliently float in a direction transverse to a plane extending vertically through the axis of rotation for the backing roller means, (e) the mounting means including two carrier elements pivotally mounted on opposite sides of a carrier body portion and biasing means mounted on said carrier body portion for resiliently urging the carrier element about its pivot toward the cutting means, (f) a bearing wheel being rotatably mounted on each of the carrier elements, (g) said carrier body portion is slidably fixed on shaft means extending in a direction parallel to the axis of rotation for the roller means and is laterally movable to effect movement of the roller means in direction parallel to the axis of rotation for the roller means, (h) said cutting element being mounted for disposition adjacent a bearing wheel to cut against said adjacent bearing wheel upon each rotation of the cutting element.

2. The mechanism as defined in claim 1 wherein the biasing means includes a spring for urging each carrier element about its pivot point.

3. The mechanism as defined in claim 1 wherein the base means includes a plurality of fixed cutting positions including means for attaching the cutting element at a fixed cutting position.

4. The mechanism as defined in claim 3 wherein the base means is disposed on shaft means which is laterally adjustable along the longitudinal axis of rotation of the cutting means.

5. A mechanism for cutting sheets from a web of thin material such as polyethylene, polypropylene and polyesters and having a tear strip superimposed thereon, said mechanism comprising:

(a) first rotatively mounted backing roller means, (b) first cutting means including a detachable cutting element rotatively mounted adjacent the first backing roller means to effect intermittent cutting of the tear strip on each rotation thereof against said first backing roller means, (c) second rotatively mounted backing roller means laterally displaced from said first backing roller means, (d) second cutting means rotatively mounted adjacent the second backing roller means to effect cutting of a sheet from a web of material, (e) the first backing roller means being freely rotatably mounted about its axis of rotation, (f) means mounting said first backing roller means to resiliently float in a direction transverse to a plane extending vertically through the axis of rotation for the backing roller means, (g) the mounting means including a carrier element mounted on a carrier body portion and biasing means mounted on said carrier body portion for resiliently urging the carrier element toward the cutting means, (h) said backing roller means being rotatably mounted on the carrier element, (i) said carrier body portion is slidably fixed on shaft means extending in a direction parallel to the axis of rotation for the roller means and is laterally movable to effect movement of the roller means in a direction parallel to the axis of rotation for the roller means, (j) guide means direct the tear strip from a supply means to the working position of the first backing roller means, (k) first draw roller means is disposed to draw the web of material into the cutting mechanism, (l) main drive gear means rotates the second cutting means to cut sheets from the web of material, (m) first timing belt means couple the rotating main drive gear means to the first drive roller means for rotating the first drive roller means, (n) the length of the sheets of material being directly dependent upon the diameter of the main drive gear means, (o) second draw roller means is disposed to draw the tear strip from supply means, and (p) second timing belt means couples the first draw roller means to the second draw roller means for rotating the second draw roller means, (g) the main drive gear means includes a single interchangeable drive gear member for changing the length of sheet to be cut from the web of material.

6. The mechanism as defined in claim 5 wherein third timing belt means couples the main drive gear means to the first cutting means for rotating the first cutting means.

7. The mechanisms as defined in claim 5 wherein the backing roller means is a bearing wheel.

8. The mechanism as defined in claim 5 wherein there are two carrier elements with a carrier element being disposed on opposite sides of the carrier body, a bearing wheel is mounted on each carrier element, and a rotatably mounted cutting element is mounted adjacent each bearing wheel.

9. The mechanism as defined in claim 5 wherein the carrier element is pivotally mounted, and the biasing means includes a spring urging the carrier element about its pivot point.

10. The mechanism as defined in claim 5 wherein the cutting element is detachably mounted on a rotatable base means, the base means includes a plurality of fixed cutting positions including means for attaching the cutting element at a fixed cutting position.

11. The mechanism as defined in claim 10 wherein the base means is disposed on shaft means which is laterally adjustable along the longitudinal axis of rotation of the cutting means.

12. A cutting mechanism comprising:

(a) backing roller means having a longitudinal axis of rotation, (b) rotatably mounted cutting means having a cutting edge and a longitudinal axis of rotation disposed parallel to the axis of rotation of the roller means, (c) said backing roller means being freely rotatably mounted about its axis of rotation, (d) means mounting the backing roller means to resiliently float in a direction transverse to a plane extending vertically through the axis of rotation for the backing roller means, (e) said mounting means being laterally movable to effect movement of the roller means in a direction parallel to the axis of rotation for the roller means, (f) said cutting means being mounted for disposition adjacent the backing roller means to cut against the backing roller means upon each rotation thereof, (g) the cutting means including a cutting element detachably mounted on a rotatable base means, (h) the base means includes a plurality of fixed cutting positions including means for attaching the cutting element at a fixed cutting position, (i) the base means is disposed on shaft means which is driven by eccentric drive means to vary the peripheral speed of the cutting element upon rotation thereof.

13. A mechanism for cutting sheets from a web of thin material having a tear strip superimposed thereon, said mechanism comprising:

(a) first rotatively mounted backing roller means, (b) first cutting means rotatively mounted adjacent the first backing roller means to effect cutting of the tear strip against said first backing roller means, (c) second rotatively mounted backing roller means laterally displaced from said first backing roller means, (d) second cutting means rotatively mounted adjacent the second backing roller means to effect cutting of a sheet from a web of material, (e) the first backing roller means being freely rotatably mounted about its axis of rotation, (f) means mounting said first backing roller means to resiliently float in a direction transverse to a plane extending vertically through the axis of rotation for the backing roller means, (g) said mounting means being laterally movable to effect the movement of the roller means to a working position and in a direction parallel to the axis of rotation for the roller means, (h) first draw roller means being disposed to draw the web of material into the cutting mechanism, (i) main drive gear means rotates the second cutting means to cut sheets from the web of material, (j) first timing belt means couple the rotating main drive gear means to the first drive roller means for rotating the first drive roller means, (k) the length of the sheets of material being directly dependent upon the diameter of the main drive gear means, (l) second draw roller means is disposed to draw the tear strip from supply means, (m) second timing belt means couples the first draw roller means to the second draw roller means for rotating the second draw roller means, (n) third timing belt means couples the main drive gear means to the first cutting for rotating the first cutting means, (o) eccentric drive means interconnect the third timing belt means to the first cutting means to vary the peripheral speed of the cutting means.

14. The mechanism as defined in claim 13 wherein the main drive gear means includes a single interchangeable drive gear member for changing the length of sheet to be cut from the web of material.

15. A mechanism for cutting sheets from a web of thin material having a tear strip superimposed thereon, said mechanism comprising:

(a) first rotatively mounted backing roller means, (b) first cutting means rotatively mounted adjacent the first backing roller means to effect cutting of the tear strip against said first backing roller means, (c) second rotatively mounted backing roller means laterally displaced from said first backing roller means, (d) second cutting means rotatively mounted adjacent the second backing roller means to effect cutting of a sheet from a web of material, (e) the first backing roller means being freely rotatably mounted about its axis of rotation, (f) means mounting said first backing roller means to resiliently float in a direction transverse to a plane extending vertically through the axis of rotation for the backing roller means, (g) said mounting means being laterally movable to effect the movement of the roller means to a working position and in a direction parallel to the axis of rotation for the roller means, (h) the cutting means including a cutting element detachably mounted on a rotatable base means, (i) the base means including a plurality of fixed cutting positions including means for attaching the cutting element at a fixed cutting position.

* * * * *